United States Patent [19]

Eberle et al.

[11] 4,127,262

[45] Nov. 28, 1978

[54] APPARATUS FOR DESTACKING FLEXIBLE FLAT STRUCTURES

[75] Inventors: Jürg Eberle, Hinwil; Willy Leu, Pfäffikon, both of Switzerland

[73] Assignee: Ferag AG, Hinwil, Switzerland

[21] Appl. No.: 818,819

[22] Filed: Jul. 25, 1977

[30] Foreign Application Priority Data

Jul. 29, 1976 [CH] Switzerland ..... 9713/76

[51] Int. Cl.[2] ..... B65H 5/08

[52] U.S. Cl. ..... 271/12; 271/35; 271/102; 271/106

[58] Field of Search ..... 271/11, 12, 99–102, 271/106, 35

[56] References Cited

U.S. PATENT DOCUMENTS

| | | | |
|---|---|---|---|
| 1,876,606 | 9/1932 | Bushnell | 271/99 X |
| 3,356,363 | 12/1967 | Ehlscheid | 271/35 X |
| 3,552,740 | 1/1971 | Hepp | 271/12 |

FOREIGN PATENT DOCUMENTS

| | | | |
|---|---|---|---|
| 516,274 | 1/1931 | Fed. Rep. of Germany | 271/12 |
| 2,117,311 | 10/1972 | Fed. Rep. of Germany | 271/12 |

*Primary Examiner*—Richard A. Schacher

*Attorney, Agent, or Firm*—Werner W. Kleeman

[57] ABSTRACT

An apparatus for destacking a stack of flexible flat structures, especially unfolded or folded sheets or printed products, comprising a stack support composed of revolving driven rolls and contact rails disposed above the stack support for defining a stack support surface. A separation device is arranged below the stack support and revolvingly driven in cycle or rhythm with the arriving rolls in order to continuously downwardly remove an edge of the momentarily lowermost flat structure between the arriving rolls. A conveyor device engages below the stack support for the removal of the printed products which have arrived beneath the stack support. The stack support surface is arranged to be at an inclination or directed obliquely at one of its corners towards the direction of movement of the rolls. The separation device comprises a single pre-separation element and guide means in order to displace the separation element at the region of said corner of the stack support surface from the top towards the bottom to thereafter remove such in the revolving direction out of the region of the stack support surface. The conveyor device possesses an endless, continuously driven conveyor element.

9 Claims, 10 Drawing Figures

APPARATUS FOR DESTACKING FLEXIBLE FLAT STRUCTURES

BACKGROUND OF THE INVENTION

The present invention relates to a new and improved construction of apparatus for destacking a stack of flexible flat structures, especially unfolded or folded sheets or printed products, comprising a stack support in the form of revolvingly driven rolls, contact rails arranged above the stack support for defining a stack support surface, a separation device arranged below the stack support and revolvingly driven in rhythm with the arriving rolls for the continuous downward removal of the edge of the momentarily lowermost located flat structure between the arriving rolls, and a conveyor device engaging below the stack support for removing the printed products arriving beneath the stack support.

According to a prior art apparatus as disclosed in German patent publication No. 1,536,489 of comparable construction, there are provided removal or withdrawal rolls in a revolving roller frame between groups of support rolls forming the stack support. The withdrawal rolls are driven to rotate opposite to the direction of revolving motion of the roller frame. Furthermore, these withdrawal rolls have mounted thereat suction cups which engage at the pre-fold of the lowermost situated sheet of the stack which is to be destacked and transport such engaged sheet, following winding-up thereof onto the roll sheell or jacket during the course of the revolving motion of the roller frame, to a removal station, where the sheet must be unwound from the withdrawal roll, in order to thereafter be delivered to a separation device. With the aid of the revolvingly driven roll of the stack support it is intended to render possible, with this prior art apparatus, that the withdrawal rolls wind-off at the stack support surface and thus are capable of winding-up the lowermost sheet.

Furthermore, an apparatus of the previously mentioned type is known form German patent publication No. 2,260,789. Here, the stack support is formed by a series of rolls or rollers which are anchored at their ends in bearing rings and thus are grouped together into a rotatably driven drum. In similar fashion, yet with fewer rolls, the separation device likewise forms a drum which is eccentrically arranged within the first drum and thus is driven in the same direction or sense, so that during operation of the system the rolls of the separation device engage in the manner of gears between the rolls of the first drum. The rolls of the separation device are equipped with recesses or depressions connected with a negative pressure source, in order to engage in each case the edge of the lowermost dispositioned flat structure — here there are processed newspapers. Additionally, the rolls of the separation device are driven about their own axis in a direction opposite to the common direction of rotation of both drums, in order to downwardly pull the engaged newspaper edge between neighboring rolls of the first drum. However, with this action the rolls of the separation device have not yet fulfilled their function. Indeed, they must additionally ensure that the newspapers are slid between the rolls of the smaller drum, and the rolls of the separation device must transport the newspapers during a long and complicated course of movement. As a result, the position of the newspapers is altered a number of times and upon transfer thereof to the conveyor device there do not prevail any clear or fixed conditions. A limited intermediate stack — as contemplated by the prior art apparatus — might allow for a certain compensation, but in that case the original stack is not destacked in the sense of single separation of the articles of the stack. Finally, with the aforementioned operations the shape of the newspapers plays a considerable role, and accordingly, whenever the shape changes, something which frequently happens, it is necessary to readjust or convert the apparatus. This constitutes a real disadvantage or burden when considered in respect of the very complicated and costly construction of the separation device.

SUMMARY OF THE INVENTION

Hence, it is a primary object of the present invention to provide destacking apparatus which is not associated with the aforementioned drawbacks and disadvantages of the prior art constructions.

Another significant object of this invention aims at providing a new and improved construction of apparatus for destacking flexible flat structures wherein the destacking speed can be increased, and specifically, among other things, by simplifying the construction of the apparatus and the course of the movements carried out thereby.

Yet a further important object of this invention aims at providing destacking apparatus of the character described which, also upon transfer of the flat structures — as a general rule there are usually processed with such apparatus, but not exclusively, newspapers — to the conveyor device provides clear and unambiguous conditions, so that the stack can in fact be singularly destacked, and furthermore, the flat structures can be withdrawn at a regularity determined by the conveyor device, for instance in an imbricated stream of such flat structures.

Yet another noteworthy object of the invention, and in order to realize the aforementioned purpose, is to relieve the separation device of any conveying function, in other words, to eliminate such device from the actual separation operation, and to bring about the direct transfer of the flat structures from the stack support to the conveyor device.

In keeping with the preceding object, and starting the same in another manner, it is a further objective to have the separation device only accomplish the pre-separation, whereas the separation operation and the transfer of the flat structures to the conveyor device are carried out by the rolls themselves.

Now in order to implement these and still further objects of the invention, which will become more readily apparent as the description proceeds, the apparatus of the present development is manifested by the features that the stack support surface is positioned obliquely or at an inclination at one of its corners towards the direction of movement of the rolls or rollers. The separation device comprises a single pre-separation element and guide means, in order to displace the separation element from the top towards the bottom at the region of the aforementioned corner of the stack support surface and thereafter to displace such in the revolving sense out of the region of the stack support surface. The conveyor device comprises an endless, continuously driven conveyor element.

By virtue of this arrangement the pre-separation element, as soon as it has merely downwardly pulled a corner of the product copy or other article to be removed from the stack, between two arriving or incoming rolls, leaves the region of the stack support surface, in order to shortly thereafter return back to the region of the stack support surface, but then above the deflected edge of the still lowermost flat structure and to engage the next flat structure at its corner. After the pre-separation the separation operation is only then accomplished by the rolls or rollers, and no parts or components of the apparatus are located between the stack support and the conveyor device. The successive separation operations can be staggered quite close to one another in time, firstly because the flat structure is directly dropped onto the conveyor device by the stack support, without thereby leaving the projection of the stack support surface. Accordingly, the rolls themselves can possess a greater rotational speed, and this is especially so since the pre-separation element need not pull through for instance the entire edge, rather only a corner of the flat structure between two rolls, so that the pre-separation can be accomplished cleanly and very quickly and the flat structures can be positively and more quickly further deflected by the rolls engaging at their corner region. Due to those orderly conditions the removal of the flat structures also can be accomplished more positively and accordingly more quickly.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
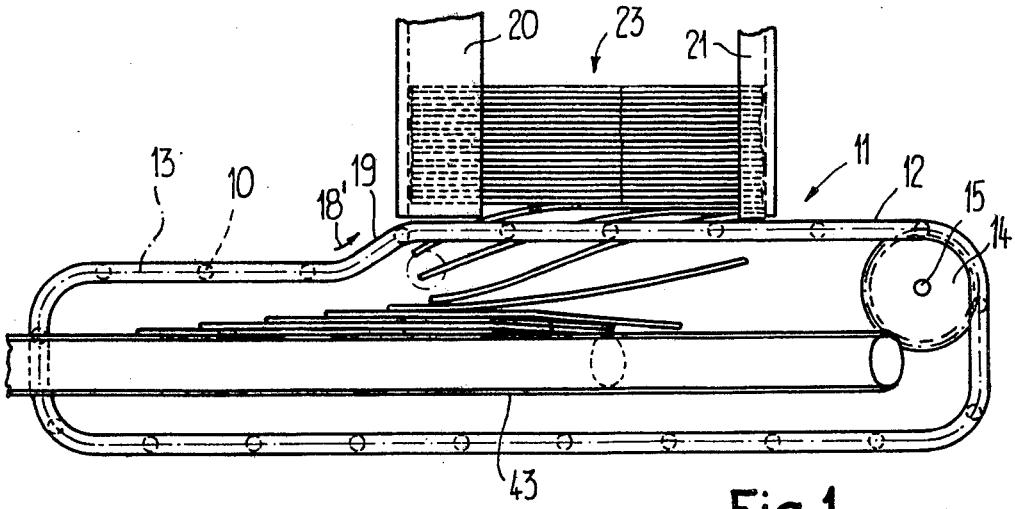
FIG. 1 is a side view of destacking apparatus constructed according to the teachings of the present invention.
Figure 2:
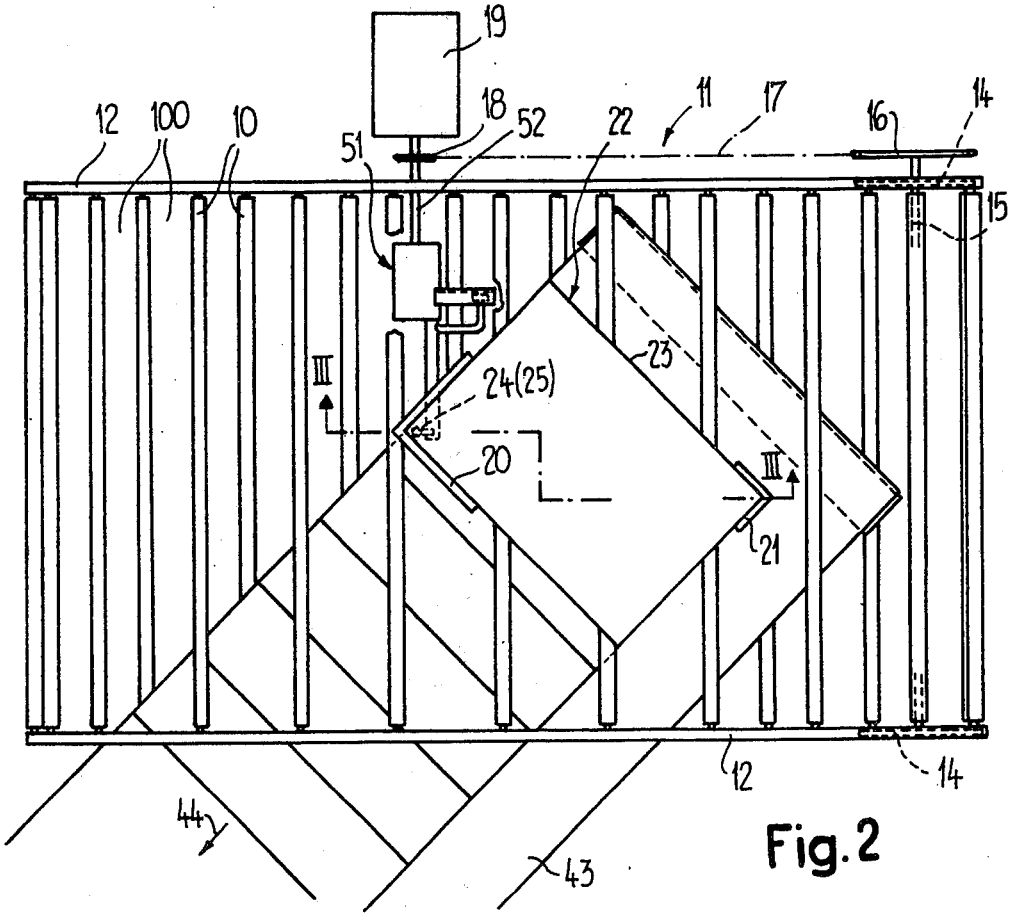
FIG. 2 is a top plan view of the apparatus shown in FIG. 1.

Describing now the drawings, according to the showing of FIGS. 1 and 2 the rolls or rollers 10 of the stack support or stack support means 11 engage at their ends into the guides or guide means 12, in each of which there is arranged an endless chain 13 which is connected with the not particularly referenced roll ends. The chains 13 are driven by the sprocket gears 14, the common shaft 15 of which supports a further sprocket gear 16. The sprocket gear 16 is connected by means of a chain 17 with the pinion 18 of a conventional gearing or transmission motor 19. The direction of rotation of the chains 13 and the rolls or rollers 10 has been indicated in FIG. 1 by the arrow 18'.

Figure 3:
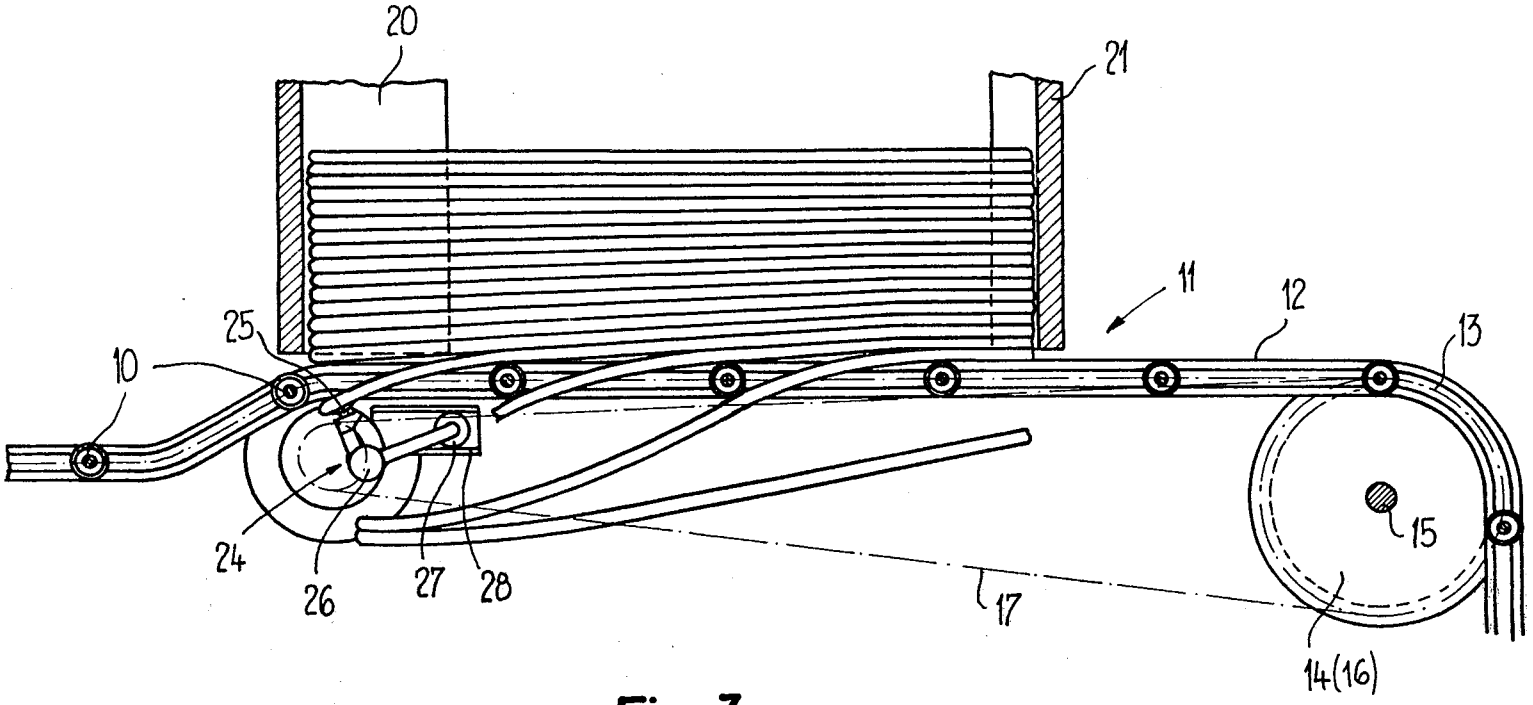
FIG. 3 is a cross-sectional view, on an enlarged scale, of the apparatus shown in FIG. 2, taken substantially along the line III—III of FIG. 2.

The roll guides 12 are provided at location 19 (FIG. 1) with a section which ascends in the direction of the stack support 11. Following this section, in the direction of rotation of the chains 13 and the rolls 10, there is located above the stack support the contact rails 20 and 21 which define the support surface or base, generally indicated by reference character 22 in FIG. 2, of a stack 23 inserted between the contact or guide rails 20 and 21 and resting upon the stack support 11. As will be best seen by referring to FIG. 2, the stack support surface or base is arranged at one of its corners so as to extend at an inclination or obliquely towards the direction of movement 18' of the rolls or rollers 10. Below the aforementioned corner of the stack support 22, which corner is engaged by the contact rail 20, there is disposed a separation or separating element 24 having a suction cup 25, as particularly well illustrated in FIGS. 3, 9 and 10. The suction cup 24 or equivalent structure is supported and movably guided by means of an arrangement which will be disclosed more fully hereinafter, this arrangement basically constituting an angle lever. This designation thus also will be used hereinafter in conjunction with the reference character 26 for the aforementioned arrangement, irrespective of the constructional details thereof.

As will be clearly seen from the showing of FIGS. 3 to 6, the suction cup 25 is located at one end of an angle lever 26, the other end of which is guided by means of a roller or follower roll 27 in a cam or guideway 28 or equivalent structure. At location 29 the angle lever 26 possesses a pivot bearing which is eccentrically anchored at a planetary gear 30. The planetary gear 30 is rotatably mounted at one end of a support 32 revolvingly driven in the sense of the arrow 31 and it possesses teeth meshing with an internally toothed rim or ring gear 33. Due to rotation of the support 32 the planetary gear 30 rolls upon the internally toothed rim or ring gear 33, and it rotates about its own axis in the direction of the arrow 34. The pivot bearing 29 thus moves along a path of travel which is in the shape of a hypocycloid, this path of travel being indicated by reference character 35 in FIG. 9.

Figure 4:
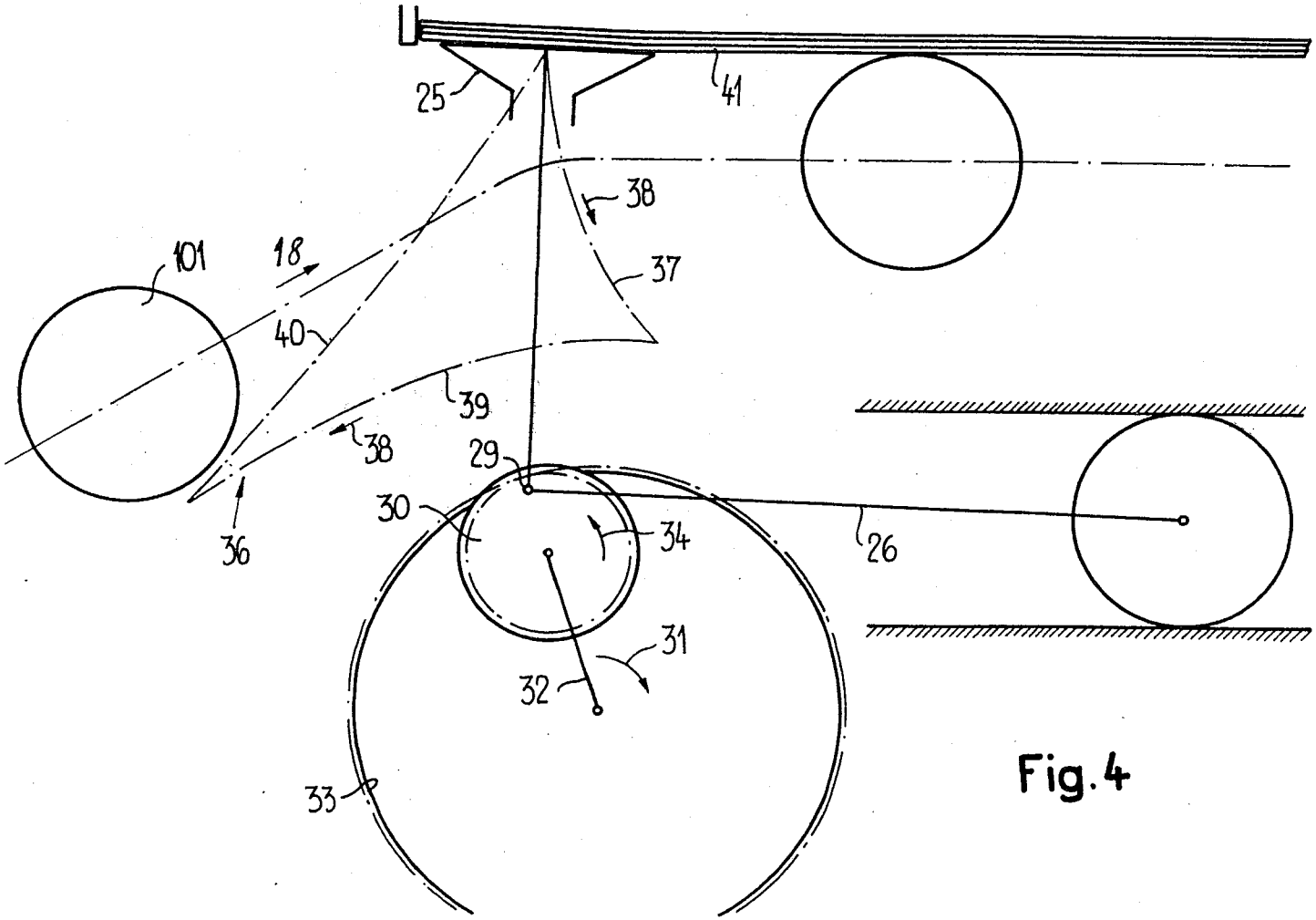
FIGS. 4, 5, 6 and 7 show in respective schematic views successive phases of the function of the separation element.
Figure 5:
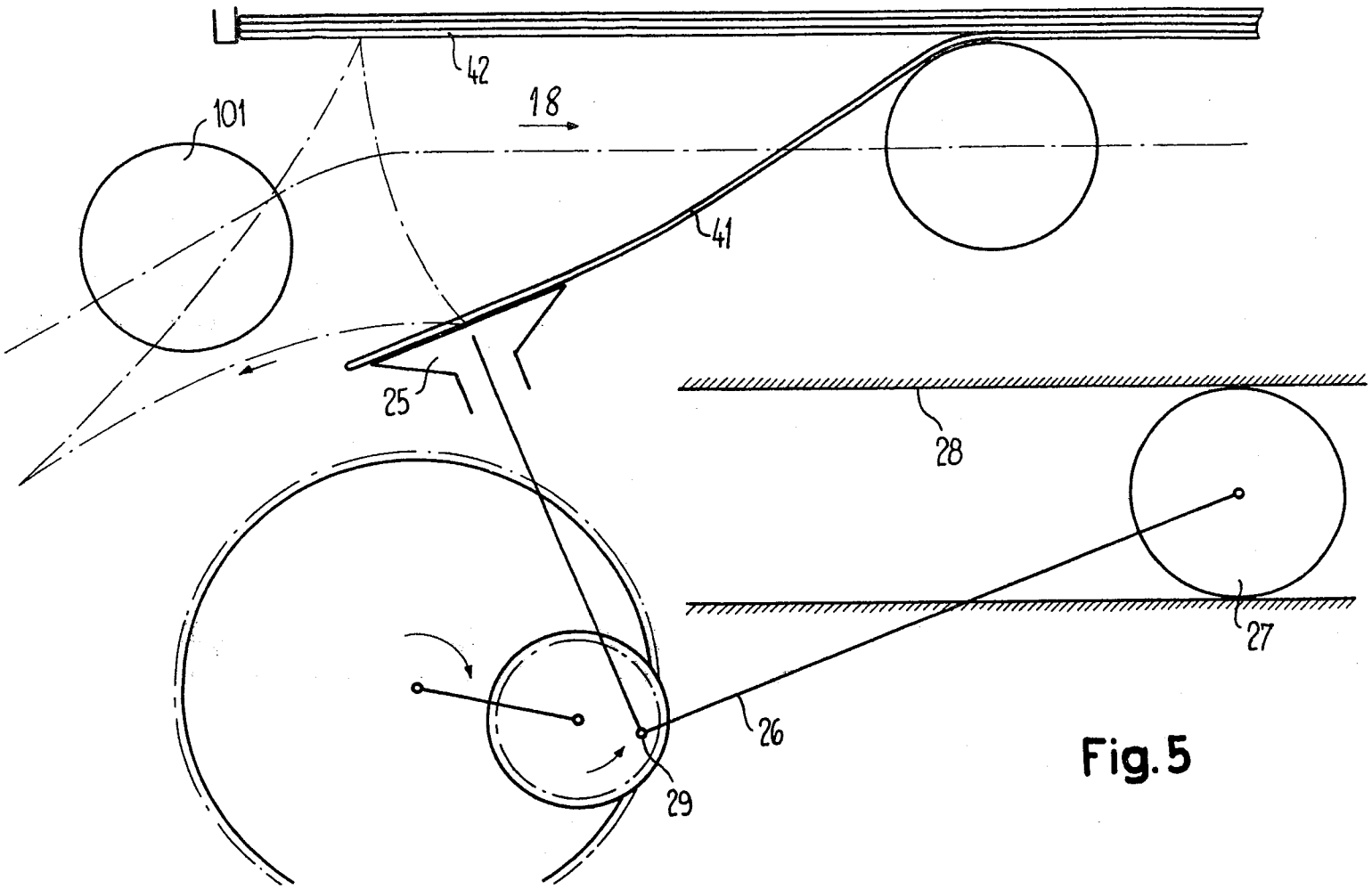
Figure 6:
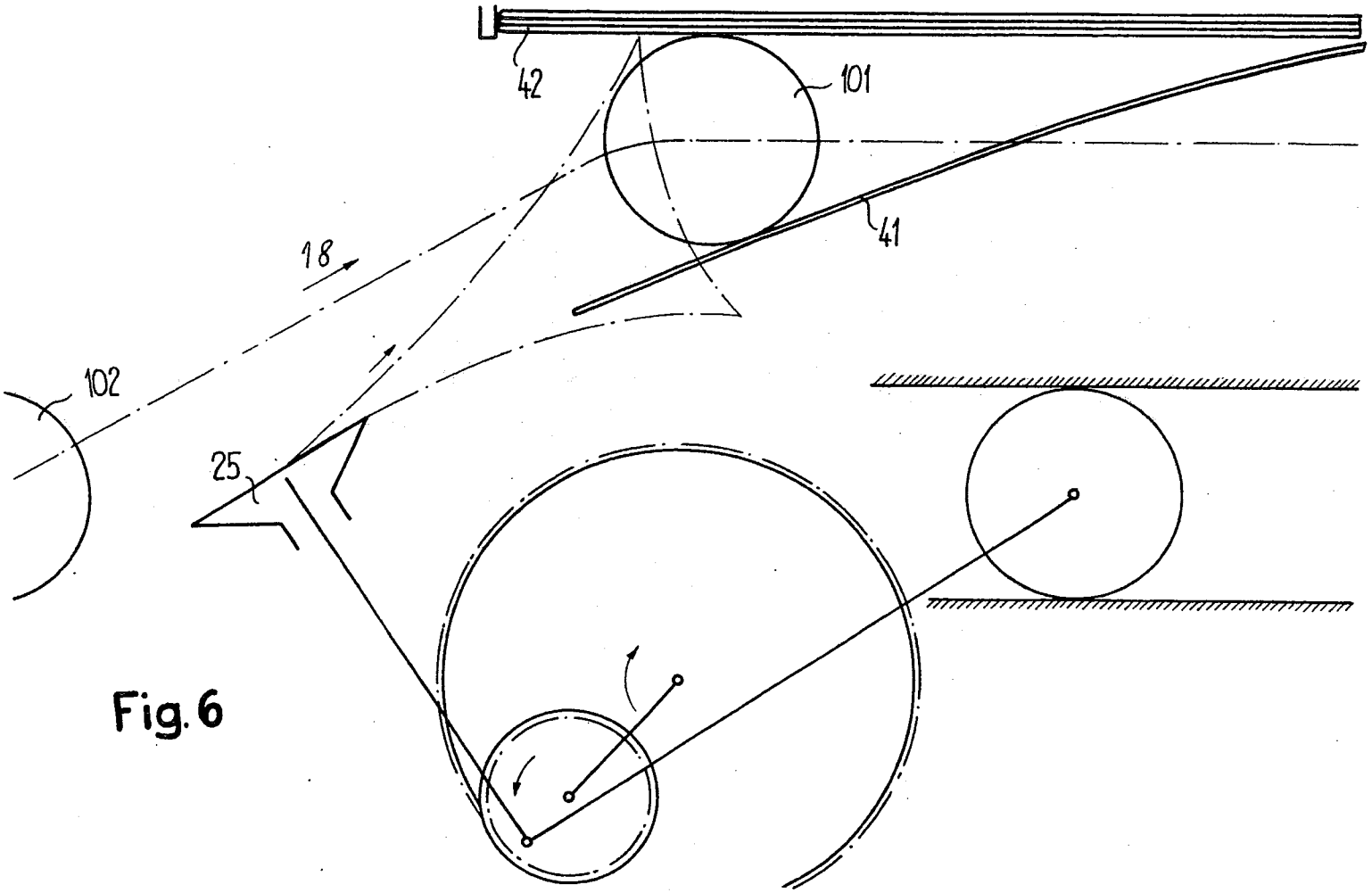
Figure 7:
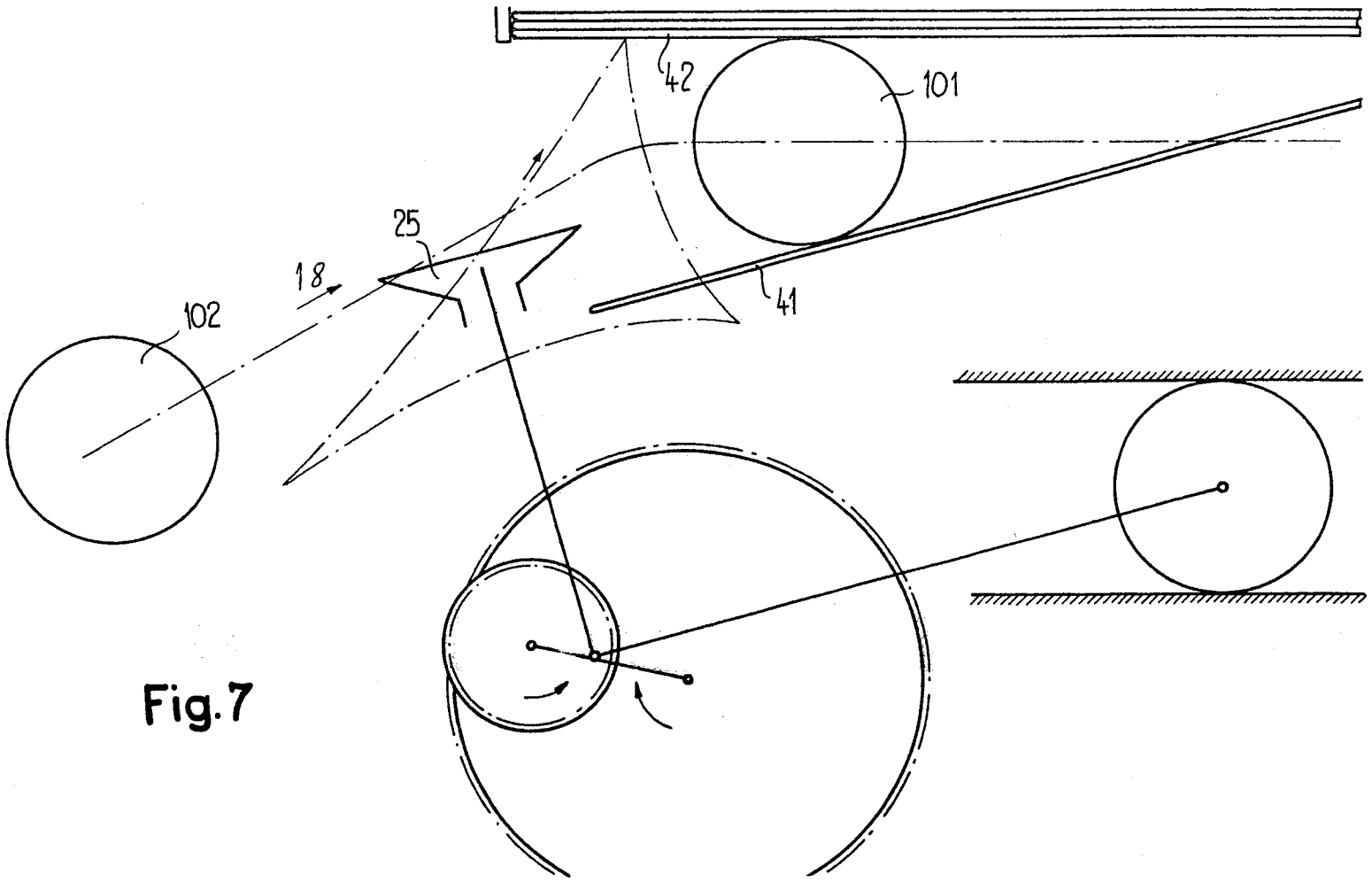

Corresponding to the path of rotation of the pivotal or pivot pin 29 the suction cup also moves along a revolving path of travel, which, — as for instance apparent and indicated by reference character 36 in FIG. 4 — is comparable to a hypocycloid, but in comparison to such possesses a distorted shape, namely a shape which is prolonged or elongated towards one side owing to the linear guiding of the other end of the angle lever 26. The arrangement is carried out such that the revolving path of travel 36 possesses a section 37 which extends at the region of the stack support surface from the top of the stack support towards the bottom i.e., from a higher elevational position towards a lower elevational position, as well as a further section 39 which follows the first mentioned section in the revolving sense, i.e., in the sense of the arrow 38, this section 39 extending away from the region of the stack support surface or base. Due to these measures the suction cup 25, when in its upper dead-center position (FIG. 4), engages into the stack support surface or base, it moves out of this position during the course of its revolving movement along the section 37 to or towards the underside of the stack support and then, during the course of its movement, it departs along the section 39 of its revolving path of travel out of the region of the stack support surface, i.e., thus it moves out of the projection of the stack support surface (in a lateral dead-center position). From this location the section 40 of the revolving path of travel of the suction cup 25 again returns back into its upper dead-center position.

Figure 8:
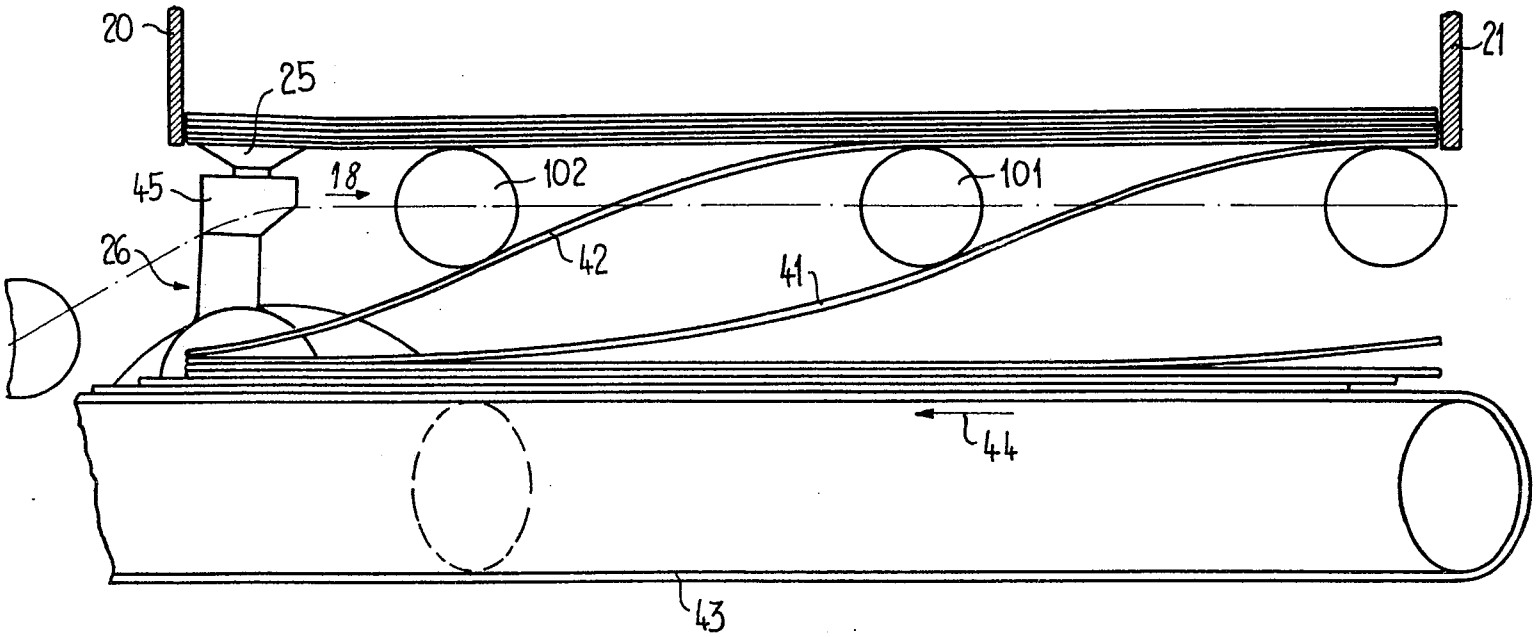
FIG. 8 is a detail corresponding approximately to the showing of FIG. 3, on an enlarged scale, wherein however the separation element is located in its position as shown in FIG. 4.

During its described revolving path of travel the suction cup 25 is of course driven in rhythm with the rolls 10 moving therepast in such a manner that the suction cup 25 after the throughpassage of one roller engages into the opening or passage 100 between such and the following roller or roll, as thus seen by referring to FIG. 4, but however then retracts at the correct point in time, in order to free the way for the mentioned trailing roller (FIG. 5), and then immediately thereafter the suction cup 25 is again returned into its upper dead-center position through the opening or passage 100 following the last mentioned roll. In the same rhythm there also operates a valve arrangement to be discussed more fully hereinafter, which operatively connects the suction cup 25 with a negative pressure source. The measures which are carried out in this regard are undertaken such that the suction cup is connected latest in its upper dead-center position with the negative pressure souce, however disconnected therefrom in its lower dead-center position, so that in other words the suction cup is activated upon passing through the section 37 of its revolving path of travel, but at other times is however passive in its function. By virtue of the foregoing there is realized the following described mode of operation, considered in conjunction with the illustrations of FIGS. 3 to 7:

In its upper dead-center position the suction cup 25 engages at negative pressure with the corner of the flat structure located lowermost in the stack 23, indicated in FIG. 4 by reference character 41. The aforementioned corner of the flat structure confronts the direction of movement of the system. The suction cup 25 during its movement into its lower dead-center position, draws the engaged corner of the flat structure 41 from the top of the stack support through the passage or opening 100. The next following roll — indicated by reference character 101 in FIG. 5 — can only travel over the deflected corner of the flat structure 41, as best seen by referring to FIG. 6. As soon as this happens, the suction cup 25 is disconnected from the negative pressure source and it continues its revolving path of travel, and as best seen by referring to FIG. 7, it moves around the corner of the flat structure 41 which is held in its deflected position by the roll 101, again back into its upper dead-center position, in order to engage at that location the corresponding corner of the now lowermost flat structure 42 and to draw such corner into the passage or opening between the roll 101 and the next following roll 102. Now the roll 102 travels over the deflected corner of the flat structure 42 and the suction cup 25 continues its revolving motion. During the course of their inherent revolving movement the rolls or rollers 101 and 102 — as such will be especially well recognized by referring to FIG. 8 — bring about a successive separation of the flat structures 41 and 42 from the stack. In this manner, and as will also be apparent from FIGS. 1 and 3, the stack can be spread apart in downward direction and destacked.

Figure 9:
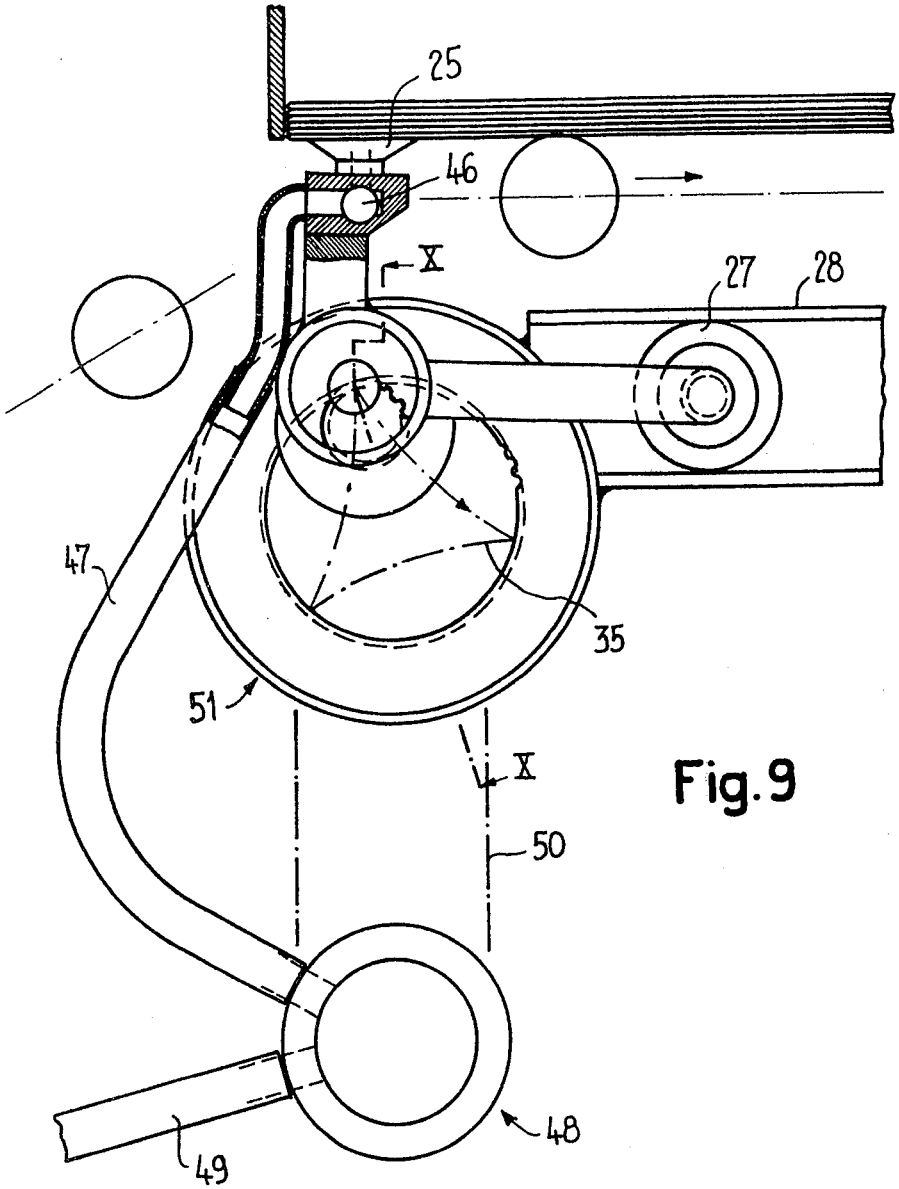
FIG. 9 is a side view of the drive means or drive for the separation element.
Figure 10:
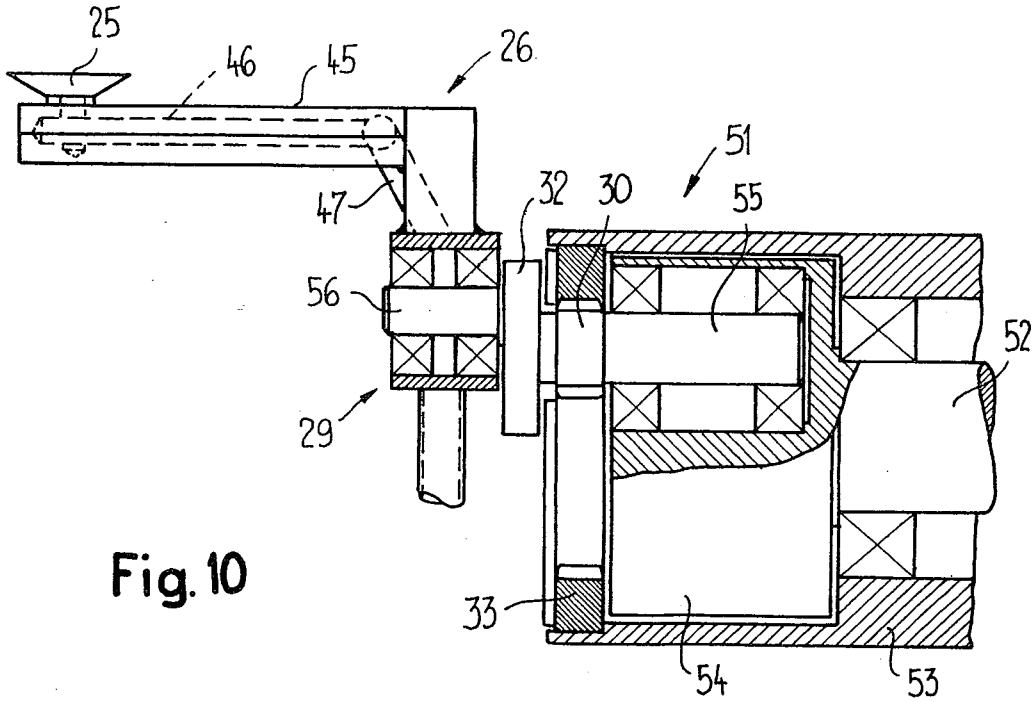
FIG. 10 is a cross-sectional view of the arrangement of FIG. 9, taken substantially along the line X—X thereof.

Below the stack support 11 there is located the end of an endless revolvingly driven conveyor band or belt 43. The flat structures which are pealed from the stack drop onto this conveyor band 43 and are transported away thereby in the direction of the arrow 44. As best seen by referring to FIG. 2, the flat structures are in an imbricated or so-called fishscale product formation. This symbolizes an appreciable aspect of the described concept: the flat structures are detached from the stack in a narrow staggering arrangement. In other words: the separation or detachment operations of the individual flat structures extensively overlap. Consequently, there is realized an enormous increase of the capacity. An appreciable role in this regard is the fact that the rollers or rolls 10 not only carry out a support function, but also a separation function and such is performed independent of the weight of the stack. FIGS. 9 and 10 show in greater detail the arrangement which heretofore was generally designated as an angle lever. There will be seen, in particular, that the arm of the angle lever 26 carrying the suction cup 25 is flexed and possesses an overhang arm 45. The suction cup 25 is connected by means of a bore 46 of the overhang arm 45 with a suction line or conduit 47 which flow communicates by means of a valve arrangement 48 with a negative pressure connection 49. The valve arrangement 48 — as generally indicated by reference character 50 — is drivingly connected with the drive or drive means of the suction cup 25 in such a manner that such suction cup 25 becomes activated when travelling through the section 37 of its revolving path of travel, but otherwise, however, is disconnected from the negative pressure source. The drive mechanism of the suction cup 25, and which drive mechanism is designated by reference character 51, is connected by a shaft 52 with the gearing or transmission motor 19. The shaft 52 which is mounted in a stationary housing 53 carries at its end facing away from the transmission motor 19 a disc 54 in which there is eccentrically mounted, with respect to the shaft 52, the shaft 55 of *a*, for instance, disc-shaped constructed support arm 32. Rigidly connected for rotation upon the shaft 55 is the planetary gear 30 and such, as already mentioned, meshes with the inner toothed rim 33 which is supported in the housing 53. The pivot bearing 29 is anchored at the support arm 32 by means of a bearing pin 56 which is eccentrically arranged with respect to the shaft 55 and thus dispositioned such that the axis of the bearing pin 56 approximately intersects the generating or roll-off circle of the planetary gear 30, so that the bearing pin travels along the hypocycloidal-shaped revolving path of travel 35. There is derived from this geometrically defined revolving path of travel 35 of the bearing pin, with the aid of the guide of the angle lever 26 by means of the roller 27 in the track 28 the revolving path of travel of the suction cup 25, which, as already mentioned, possesses the shape of a hypocycloid elongated in the direction of one tip. The plane of the revolving path of travel 36, with the illustrated exemplary embodiment, is parallel to the plane of the guides or guide means 12, but it could be more or less transversely positioned with respect to the latter. The section 19 of the guides, ascending at the region of the revolving path of travel 36, temporarily reduces the horizontal component during the rolling movement and therefore favors the function of the suction cup upon deflection of the flat structure. The inclined position of the stack is thus important insofar as in the case of a straight-standing stack it is not only necessary to deflect a corner, rather the entire edge of the flat structure, for which purpose two or more suction cups would be necessary which then must be controlled in synchronism with one another. The equipment expenditure which is needed in this regard, and which at the same time constitutes a possible source of defect, is however eliminated with the illustrated exemplary embodiment. Of course, — and mentioning this by way of completeness — it would be equally possible to use separation elements of a different type.

It should be understood that above one and the same stack support there can be provided a number of stack support surfaces, defined by appropriate contact rails or the like, and with the aid of a corresponding number of separation elements there can be destacked at the same time a number of juxtapositioned and/or tandomly arranged stacks. Of course, in this case there would be provided in the manner of the preceding embodiments also the requisite outfeed conveyor. The rollers rotate during their transitory movement about their own axis, since they roll-off at the momentary lowermost located flat structure. However, the rollers could posses a positive rotational drive, for instance by frictional connection of their ends with the same over-engaging flank of the roller guide. In this regard, the roll ends could be slightly offset in order to thereby somewhat increase the peripheral speed at the jacket surface of the rolls. The result of this would be that the flat structure located lowermost in the stack would be pressed against the contact rails 20. If necessary, it would be possible to totally avoid the use of further contact rails.

The apparatus is especially suitable for the destacking of a stack of sheets, especially folded or unfolded printed products, namely when the same are delivered as supplements or inserts to a stuffing machine or otherwise should be processed. Not only is there of importance the exceptional capacity of the apparatus, but also the possibility of not only destacking the stack, rather at the same time converting such into an imbricated formation. Of course, it would also be possible however to outfeed the products separate from one another.

While there are shown and described present preferred embodiments of the invention, it is to be distinctly understood that the invention is not limited thereto, but may be otherwise variously embodied and practiced within the scope of the following claims. Accordingly,

What is claim is:

1. An apparatus for destacking a stack of flexible flat structures, especially unfolded or folded sheets or printed products, comprising:

stack support means comprising revolvingly driven rolls moving in a predetermined direction of travel;

contact rails arranged above the stack support means for defining a stack support surface;

said stack support surface having corners;

one of said corners being dispositioned obliquely and directed opposite to the direction of travel of said rolls;

a separation device arranged below the stack support means;

means for revolvingly driving the separation device to periodically move between two neighbouring rolls of said driven rolls in order to continuously downwardly withdraw a corner of the momentarily lowermost located flat structure between said rolls;

a conveyor device disposed below and engaging beneath the stack support means for outfeeding the printed products withdrawn from the stack; and the conveyor device having a direction of movement forming an angle with respect to the direction of travel of said rolls.

2. The apparatus as defined in claim 1, wherein:

said angle defines as acute angle.

3. The apparatus as defined in claim 1, wherein:

said conveyor device comprises an endless continuously driven conveyor element.

4. An apparatus for destacking a stack of flexible flat structures, especially unfolded or folded sheets or printed products, comprising:

stack support means comprising revolvingly driven rolls moving in a predetermined direction of travel;

contact rails arranged above the stack support means for defining a stack support surface;

a separation device arranged below the stack support means;

means for revolvingly driving the separation device to periodically move between two neighbouring rolls of said driven rolls in order to continuously downwardly withdraw a corner of the momentarily lowermost located flat structure between said rolls;

an angle lever having two ends;

said separation device being arranged at one end of said angle lever;

linear guide means for guiding the other end of said angle lever;

revolvingly driven pivot bearing means at which there is mounted said separation device;

a revolvingly driven planetary gear at which there is eccentrically arranged said pivot bearing means; and a stationary internal toothed rim means with which meshes said planetary gear.

5. The apparatus as defined in claim 4, further including:

drive means for driving the planetary gear;

drive means for driving said rolls;

said drive means for the planetary gear being operatively coupled with the drive means for driving said rolls.

6. The apparatus as defined in claim 4, further including:

a respective endless, revolvingly driven chain at which there are anchored at their ends said rolls; and said separation device being arranged at an end region of a section of chain guide means which ascends towards the stack support means.

7. The apparatus as defined in claim 4, wherein:

said separation device comprises a suction cup;

drive means for driving the separation device;

valve means coupled with said drive means of the separation device and controlling said suction cup.

8. The apparatus as defined in claim 4, wherein:

said stack support surface having corners;

one of said corners being dispositioned obliquely and directed opposite to the direction of travel of said rolls.

9. The apparatus as defined in claim 4, further including:

a conveyor device disposed below the stack support means for outfeeding the printed products arriving beneath the stack support means; and said conveyor device having a conveying direction forming an angle with respect to the direction of travel of said rolls.

* * * * *